United States Patent [19]

Cunningham et al.

[11] Patent Number: 4,602,832

[45] Date of Patent: Jul. 29, 1986

[54] MULTI-ROW CONNECTOR WITH GROUND PLANE BOARD

[75] Inventors: Jack C. Cunningham, Thousand Oaks, Calif.; Benjamin G. Egerton, Jr., Tucson, Ariz.; John A. Partridge, Santa Monica, Calif.

[73] Assignee: The United States of America as represented by the Secretary of the Air Force, Washington, D.C.

[21] Appl. No.: 708,909

[22] Filed: Mar. 6, 1985

[51] Int. Cl.[4] ..... H01R 4/66

[52] U.S. Cl. ..... 339/14 R

[58] Field of Search ..... 339/14 R, 147 R, 17 LM, 339/143 R; 333/183

[56] References Cited

U.S. PATENT DOCUMENTS

| | | | |
|---|---|---|---|
| 3,334,325 | 8/1967 | Conrad et al. | 339/14 |
| 3,513,433 | 5/1970 | Carroll | 339/14 |
| 3,747,044 | 7/1973 | Vaccaro | 339/14 R |
| 4,232,929 | 11/1980 | Zobawa | 339/143 R |
| 4,243,283 | 1/1981 | McSparran | 339/14 R |
| 4,376,922 | 3/1983 | Muzslay | 333/183 X |
| 4,451,099 | 5/1984 | Bricker et al. | 339/14 R |

*Primary Examiner*—Eugene F. Desmond

*Attorney, Agent, or Firm*—Donald J. Singer; Richard J. Donahue

[57] ABSTRACT

A multi-row connector having a ground plane board mounted between rows of connector pins on the backside of the connector. Conductor shields of individual wires are soldered directly to conductor strips on the printed circuit ground plane board, and the strips are jumpered to a grounding pin on the connector.

4 Claims, 4 Drawing Figures

MULTI-ROW CONNECTOR WITH GROUND PLANE BOARD

STATEMENT OF GOVERNMENT INTEREST

The invention described herein may be manufactured and used by or for the Government for governmental purposes without the payment of any royalty thereon.

BACKGROUND OF THE INVENTION

The present invention relates to electrical connectors and particularly to a multi-row connector having a printed circuit ground plane board associated therewith for grounding the outer shields of conductors at the connector.

Many applications exist where it is necessary to transfer electrical signals representative of digital data and the like over several bundled wires from one device to another. Individual ones of these wires are usually shielded to isolate the data transmitted thereby from electromagnetic field disturbances caused by other data carrying wires, nearby power sources and the like. Crosstalk between one signal wire and another, which is particularly troublesome, also occurs at signal junction points, such as at connectors where an impedance mismatch is often formed.

A common prior art means for grounding the shields of several shielded wires which are to be terminated at a common pin of a multi-pin connector, is to solder or otherwise attach a short shield termination wire, called a pigtail wire, between adjacent shields. One of the shields is then connected by a pigtail wire to a common grounding pin on the connector.

The single grounding pigtail wire used in such a scheme has a high failure potential because of the strain placed upon it due to the bulkiness of the several shielded wires which it anchors. Should the single ground wire fail, all of the shield grounds are lost. Moreover, should an additional shielded wire be added to the group, or removed from the group, one of the series-connected shield terminations may have to be modified or reworked. In addition, the daisy-chaining of pigtail wires creates an effective antenna for inducing unwanted signals or noise into the wires.

U.S. Pat. No. 3,513,433 issued to Charles E. Carroll on May 19, 1970 recognizes the problems mentioned above and provides one solution therefor. The solution presented in this patent consists of the addition to the connector of a grounding bracket having a bar which spans the length of the connector. The bar is positioned exterior of the connector shell and has base portions, or legs, which attach to the shell. All of the shielded wires have their shield termination pigtail wires soldered to the bar.

While the aforementioned solution does eliminate some of the problems associated with the daisy-chain grounding configuration adopted earlier, it still requires that individual grounding wires or pigtails be attached to the individual shielded wires. This is a costly and time consuming operation.

U.S. Pat. No. 4,232,929 issued to Franz Zobawa on Nov. 11, 1980, provides a solution to the crosstalk problem associated with the coupling of several data signals to a common multi-row connector. A spring clamped shield or plate is inserted between one row of pins which forms a signal plane and an adjacent row of pins which forms a ground plane. The shield contacts all of the pins of the ground plane. It is stated that the concentration of the electrical field in the vicinity of the shield plate results in an overall reduction in crosstalk from one pin of the signal plane to another.

While this patent teaches a partial solution to the crosstalk problem applicable to a particular connector configuration, it does not teach any means for securing and grounding the ends of shielded wires, and appears to address itself to so-called stranded spiral quads in which two conductors arranged opposite one another serve as signal conductors and the other two conductors as ground conductors.

OBJECTS AND SUMMARY OF THE INVENTION

It is therefore the primary object of the present invention to provide a multi-row connector having improved means for grounding the shields of a plurality of shielded wires.

It is another object of the present invention to provide a multi-row connector having shield grounding structure which permits the addition or deletion of shielded wires without modification of the existing shielded wires.

It is yet another object of the present invention to provide a multi-row connector having a signal isolation barrier between adjacent rows of pins.

Briefly, the present invention comprises a multi-row connector having a printed circuit plane board mounted on the backside of the connector shell between the rows of pins. The board has one or more conductive foil grounding strips thereon to which individual shields of the shielded wires are soldered. The conductive strips are, in turn, bussed to assigned grounding pins on the connector.

The foregoing and other objects, features and advantages of the present invention will become apparent as the description thereof proceeds when considered in connection with the accompanying illustrative drawings.

DETAILED DESCRIPTION OF THE INVENTION

Figure 1A:
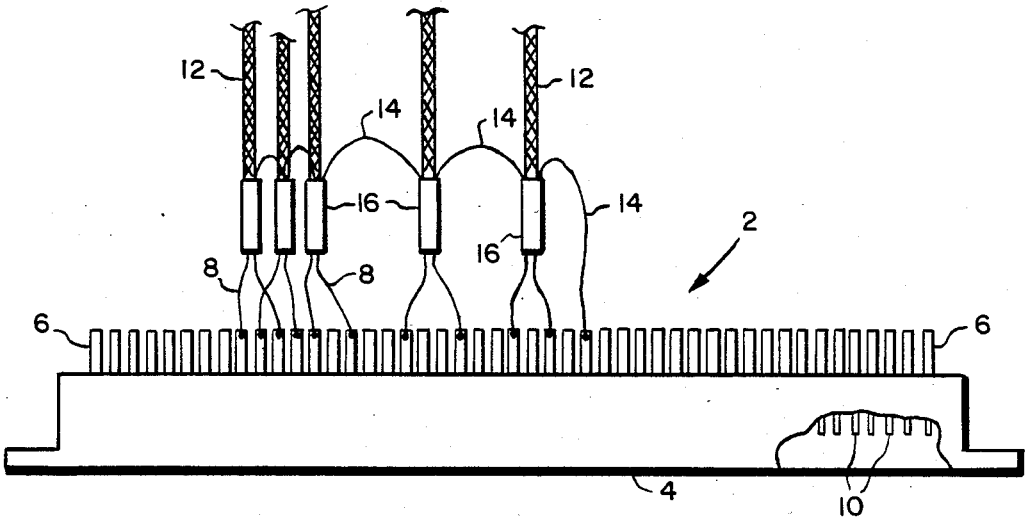
FIG. 1A PRIOR ART
FIGS. 1A and 1B are side and end views respectively of a multi-row connector of a type commonly known in the art, and having shielded wires terminated thereto in the conventional manner.
Figure 1B:
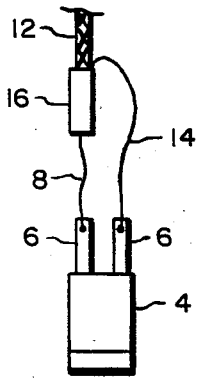
FIG. 1B PRIOR ART

Referring now to FIGS. 1A and 1B of the drawings in greater detail, there is shown a multi-row connector 2 of conventional construction having shielded wires affixed thereto. Only one such shielded wire is illustrated in FIG. 1B in order to clarify the drawing. Connector 2 has an insulative shell 4 into which are molded or inserted a plurality of metallic pins 6 which are spaced from each other and arranged in two parallel rows. The ends of the pins protruding from the back surface (backside) of insulative shell 4 have electrical wires 8 soldered thereto while the ends 10 of the pins 6, (which are visible through the portion of shell 4 which has been broken away in FIG. 1A) are adapted to mate with the pins of another connector.

Electrical wires 8 are of the type described earlier which have a metallic shield 12 woven thereabout for isolating the wires from external electromagnetic field disturbances. It is necessary that each of the outer shields 12 be electrically connected to a pin or pins 6 which serve to couple the shield to a ground or reference potential.

It has been the commonly accepted practice to affix a pigtail wire 14 to the end of each shield 12. This may be accomplished by soldering, crimping, or the like. A protective sleeve 16 is placed about the shield and pigtail wire. The sleeve is usually made of insulative material and may be a rigid plastic material capable of beg crimped, or may be heat shrinkable tubing. The last one of the pigtail wires 14 is connected to a grounding connector pin on connector 2.

As previously mentioned, the prior art method of terminating shielded wires leads to frequent failures due to the strain placed on the pigtail wires, especially the last pigtail wire which is soldered to a connector pin. In addition, the continuous ground path formed by the looped pigtail wires 14 acts as an antenna which is receptive to electromagnetic radiation.

Figure 2A:
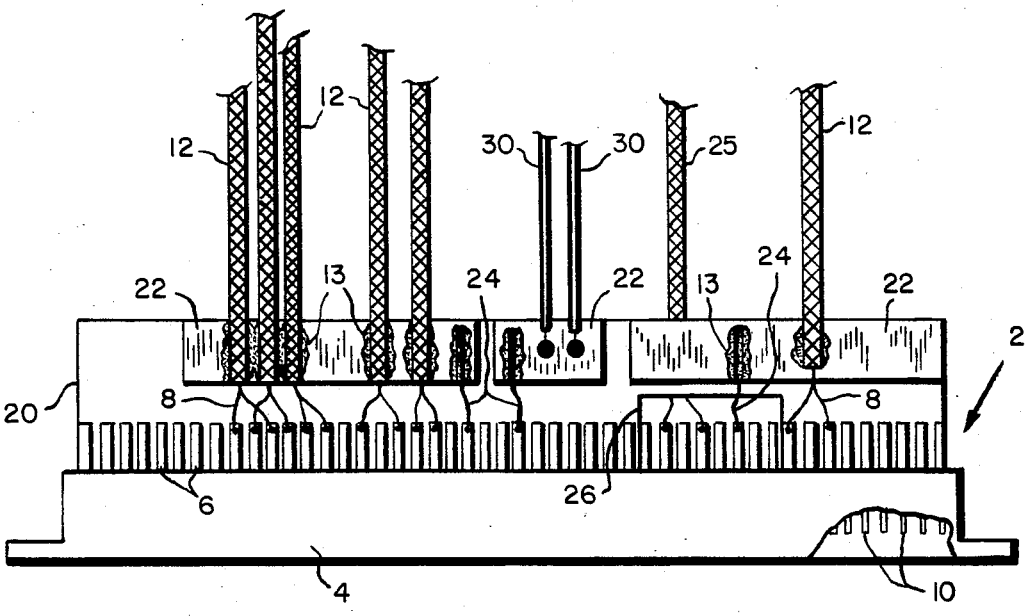
FIGS. 2A and 2B are side and end views respectively of a multi-row connector having a printed circuit ground plane board affixed thereto for grounding of shielded wires.
Figure 2B:
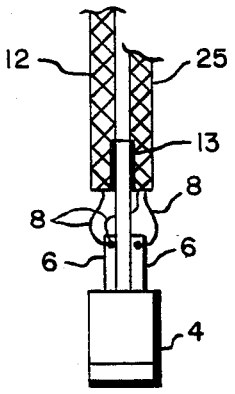

FIGS. 2A and 2B show a multi-row connector having an associated ground plane board 20 adapted to mechanically secure and electrically terminate the outer shields 12 of a number of shielded wires. Only two such shielded wires are illustrated in FIG. 2B in order to clarify the drawing. Ground plane board 20 may be a conventional printed circuit board of the type having an insulative base material, and having a number of metallic grounding strips 22 formed thereon by etching away appropriate portions of a metallic foil layer originally overlying all of the insulative base material.

Conductor shields 12 are electrically and physically bonded by solder 13 to the metallic grounding strips 22 and a single jumper wire 24 is then soldered to the grounding strip 22 and to one of the connector pins 6.

In instances, where it is desired to solder shields to the other side of ground plane board 20, such as shield 25, a printed circuit board 20 is used which has ground planes 22 formed on both surfaces thereof.

In instances where it is necessary to connect wires 8 of a shield 12 to a connector pin 6 which is situated on the opposite side of the board 20, a cutout 26 may bé made in the board 20.

It will be appreciated that the metallic strips 22 provide a degree of shielding between connector pins disposed on opposite sides of ground plane board 20, and may be enlarged to enhance this shielding. Also, that is is possible to use a grounding strip 22 for connecting two or more non-shielded wires, such as the wires 30, to a single connector pin.

Although the invention has been described with reference to a particular embodiment, it will be understood to those skilled in the art that the invention is capable of a variety of alternative embodiments within the spirit and scope of the appended claims.

What is claimed is:

1. The combination of:

an electrical connector having an insulative shell, a plurality of spaced metallic connector pins arranged in at least two parallel rows of said connector pins in said shell, said pins being adapted on one end thereof to mate with a like plurality of similarly arranged pins in another connector, said pins having the other ends thereof protruding from the backside of said insulative shell and being adapted to have the ends of electrical wires electrically secured thereto, and an insulative board of substantially rectangular shape having first and second opposed planar surfaces, said board having at least one metallic foil strip formed on at least one of said surfaces, said board having an edge thereof interposed between adjacent ones of said parallel rows of said connector pins, said edge of said board having portions thereof abutting said backside of said insulative shell, said surfaces of said board being positioned substantially perpendicular to said backside of said insulative shell and substantially parallel to the longitudinal axis of said connector pins, said surfaces of said board extending above said backside of said insulative shell in the space between said adjacent ones of said parallel rows of said connector pins;

said at least one metallic foil strip being electrically connected to one of said connector pins, said board providing a means for securing and electrically terminating the shields surrounding said electrical wires by soldering said shields to said at least one metallic foil strip.

2. The combination of claim 1 wherein said board has at least one metallic foil strip formed on said first surface thereof and at least one metallic strip formed on said second surface thereof.

3. The combination of claim 2 wherein said insulative board has a cutout therein to facilitate the routing of an electrical wire having its shield affixed to a second metallic strip on said first surface of said board to a connector pin situated adjacent said second surface of said board.

4. The combination of claim 3 wherein said cutout is at the edge of said board interposed between adjacent ones of said parallel rows of said connector pins.

* * * * *